US010480186B2

(12) United States Patent
Tanguay et al.

(10) Patent No.: US 10,480,186 B2
(45) Date of Patent: Nov. 19, 2019

(54) CLEANROOM PANEL SYSTEM

(71) Applicant: CONCEPT BIO-SECURITE INC., Saint-Remi (CA)

(72) Inventors: Patricia Tanguay, Saint-Remi (CA); Pierre Larocque, Saint-Remi (CA)

(73) Assignee: CONCEPT BIO-SECURITE INC., Saint-Remi, Quebec (CA)

( * ) Notice: Subject to any disclaimer, the term of this patent is extended or adjusted under 35 U.S.C. 154(b) by 0 days.

(21) Appl. No.: 16/001,028

(22) Filed: Jun. 6, 2018

(65) Prior Publication Data

US 2018/0283002 A1 Oct. 4, 2018

Related U.S. Application Data

(63) Continuation of application No. PCT/CA2016/051468, filed on Dec. 13, 2016.
(Continued)

(51) Int. Cl.
*E04B 2/74* (2006.01)
*E04F 13/08* (2006.01)
(Continued)

(52) U.S. Cl.
CPC ..... *E04B 2/7401* (2013.01); *E04B 9/245* (2013.01); *E04F 13/0803* (2013.01);
(Continued)

(58) Field of Classification Search
CPC .. E05B 2/82; E05B 2/7401; E05B 2002/7462; E05B 9/245; E05B 2/74;
(Continued)

(56) References Cited

U.S. PATENT DOCUMENTS 2,388,297 A 11/1945 Slaughter
3,022,869 A * 2/1962 Radek ..... E04B 2/56 52/506.08
(Continued)

FOREIGN PATENT DOCUMENTS

EP 0506502 B1 3/1996
EP 1219168 B1 2/2004
(Continued)

OTHER PUBLICATIONS

Machine translation in English of EP0506502.
(Continued)

*Primary Examiner* — Beth A Stephan
(74) *Attorney, Agent, or Firm* — Ipaxio S.E.N.C.

(57) ABSTRACT

The system includes a plurality of panels made of a thermoplastic material. The panels have a hermetically-sealed connection between them using a plurality of first thermoplastic welded junctions. The system further includes a plurality of elongated snap-in panel anchoring units. Each unit including complementary first and second members to be latched together through an interfering engagement. At least the first member of each snap-in panel anchoring unit is made of a thermoplastic material and these first members are attached to the outboard major surface of the panels using a plurality of second thermoplastic welded junctions.

20 Claims, 12 Drawing Sheets

Related U.S. Application Data

(60) Provisional application No. 62/272,037, filed on Dec. 28, 2015.

(51) Int. Cl.
*E04F 19/06* (2006.01)
*E04B 9/24* (2006.01)

(52) U.S. Cl.
CPC ..... *E04F 13/0851* (2013.01); *E04F 13/0898* (2013.01); *E04F 19/064* (2013.01)

(58) Field of Classification Search
CPC ..... E04F 13/0803; E04F 13/0851; E04F 13/0898; E04F 19/064
See application file for complete search history.

(56) References Cited

U.S. PATENT DOCUMENTS

| | | | | |
|---|---|---|---|---|
| 3,279,971 | A * | 10/1966 | Gardener | B05C 17/00516 425/192 R |
| 3,621,635 | A * | 11/1971 | De Lange | E04F 13/083 29/460 |
| 3,641,723 | A | 2/1972 | Delcroix | |
| 3,671,061 | A * | 6/1972 | Dawdy | E04F 13/0812 411/30 |
| 4,580,385 | A * | 4/1986 | Field | E04B 2/7457 52/489.1 |
| 4,854,094 | A | 8/1989 | Clark | |
| 4,909,013 | A * | 3/1990 | Daw | E04C 2/52 52/393 |
| 5,247,901 | A | 9/1993 | Landon et al. | |
| 5,256,105 | A | 10/1993 | Austin | |
| D344,596 | S | 2/1994 | McArthur | |
| 5,297,370 | A | 3/1994 | Greenstreet et al. | |
| 5,645,480 | A | 7/1997 | Spengler | |
| 5,941,040 | A | 8/1999 | McAnallen et al. | |
| 5,996,299 | A * | 12/1999 | Hsueh | E04B 2/7863 52/479 |
| 6,070,377 | A | 6/2000 | Guevara Guzman | |
| 6,164,024 | A | 12/2000 | Konstantin | |
| 6,430,885 | B1 * | 8/2002 | Ito | E04F 13/0812 52/235 |
| 6,715,239 | B2 | 4/2004 | Passalacqua et al. | |
| 6,993,875 | B2 | 2/2006 | Rudduck | |
| 7,127,865 | B2 | 10/2006 | Douglas | |
| 7,921,893 | B2 | 4/2011 | Beehag et al. | |
| 8,910,439 | B2 | 12/2014 | Ingjaldsdottir et al. | |
| 9,003,737 | B2 | 4/2015 | Solomon et al. | |
| 9,051,741 | B2 | 6/2015 | Bilge | |
| 9,169,641 | B2 | 10/2015 | Wickstrom | |
| 9,169,653 | B2 * | 10/2015 | Porter | E04F 13/08 |
| 9,328,518 | B2 * | 5/2016 | Bilge | E04F 13/07 |
| 9,708,817 | B2 * | 7/2017 | Gestetner | E04F 13/081 |
| 2003/0110726 | A1 * | 6/2003 | Rudduck | E04B 2/7455 52/474 |
| 2005/0095977 | A1 | 5/2005 | Hatz | |
| 2005/0193643 | A1 | 9/2005 | Pettus | |
| 2005/0257461 | A1 * | 11/2005 | Daly, IV | E04F 19/064 52/254 |
| 2010/0304658 | A1 | 12/2010 | Grcevic | |
| 2012/0077429 | A1 | 3/2012 | Wernimont et al. | |
| 2013/0206616 | A1 | 8/2013 | Allen et al. | |

FOREIGN PATENT DOCUMENTS

| | | | |
|---|---|---|---|
| FR | 2041234 | A5 | 1/1971 |
| FR | 2745045 | B1 | 4/1998 |
| FR | 2826386 | B1 | 7/2004 |
| GB | 2346627 | A | 8/2000 |
| NL | 2008099 | C | 7/2013 |
| WO | 9726459 | A1 | 7/1997 |
| WO | 2011140665 | A1 | 11/2011 |
| WO | 2017113007 | A1 | 7/2017 |

OTHER PUBLICATIONS

Machine translation in English of FR2041234.
Machine translation in English of FR2745045.
Machine translation in English of FR2826386.
Position Statement: Every pig barn should have a minimum of a Danish Entrance, Ontario Pork Industry Council, Nov. 2007.
International Search Report and the Written Opinion from ISA/CA for PCT/CA2016/051468 dated Feb. 7, 2017.

* cited by examiner

CLEANROOM PANEL SYSTEM

CROSS REFERENCE TO PRIOR APPLICATIONS

The present case is a continuation of PCT Application No. PCT/CA2016/051468 filed on 13 Dec. 2016. PCT/CA2016/051468 claims the benefits of U.S. patent application No. 62/272,037 filed on 28 Dec. 2015. The contents of these two prior patent applications are hereby incorporated by reference.

TECHNICAL FIELD

The technical field relates generally to panel systems for use in cleanroom constructions.

BACKGROUND

A cleanroom can be generally defined as a closed sealable space that prevents contaminants from getting in or out. Some cleanrooms are provided so as to keep a workplace substantially free of contaminants, such as dust, airborne microbes, aerosol particles, chemical vapors, etc. These contaminants might otherwise interfere with the precision work undertaken there and/or alter the quality of the products being made. Others cleanrooms are provided to prevent chemical and/or biological contaminants from being released in the surrounding environment. These cleanrooms can often be found in research facilities or the like, but a cleanroom can also be used as a quarantine zone, for example a quarantine zone for living animals. Animal biosecurity is increasingly a concern and many diseases can spread very fast in the air over vast distances, sometimes many kilometers from a source. An example is the porcine reproductive and respiratory syndrome (PRRS) virus. This virus is highly infectious and can spread in the air up to 8 kilometers from a source. It has a substantial economic burden on the industry in affected areas. Some are even considering having cleanrooms on trucks for transporting healthy animals across some areas as part of their biosecurity protocols.

The term "cleanroom" refers primarily to the closed sealable space but it also refers the surrounding structural parts required to create it. Generally, a cleanroom minimally includes walls, a ceiling, a floor and anything that is required to access the space therein, for instance a door. A cleanroom often requires using a dedicated air filtering system to prevent the contaminants from leaving or entering, depending on the situation. The interior of the cleanroom is maintained either at a negative pressure relative to the surrounding outside environment when the contaminants are considered to be inside, or either at a positive pressure relative to the surrounding outside environment when the contaminants are considered to be outside.

The size of a cleanroom can vary immensely from one implementation to another. Some cleanrooms can be made very small while others can be large enough to have several persons working simultaneously therein. One approach to simplify the design and the construction of cleanrooms is to use modular panels as basic elements. Cleanrooms of various sizes and configurations are then built using a number of these panels for at least a part of their structure. Modular panels can be used for walls, ceilings and/or floors. They can also lower costs. They are generally attached to an external supporting structure that will hold them in place. The external supporting structure can be structural elements of an existing room or compartment, and/or be a dedicated framework or armature installed together with the panels.

U.S. Pat. No. 9,169,641 to Wickstrom discloses a cleanroom wall panel system. The system includes retainer elements to secure the wall panels. The wall panels are lifted prior to move them into position and then lowered to secure them to the retainer elements. However, this requires a clearance space between the top edge of the wall panels and the ceiling. Once the wall panels are in position, the clearance space must be closed and sealed. This arrangement is also not suitable for ceiling and floor panels.

Although various arrangements have been proposed in the past for creating cleanrooms, the design and the construction of cleanrooms often remain challenging for various reasons. Room for improvements always exists in this technical area.

SUMMARY

In one aspect, there is provided a cleanroom panel system including: a plurality of panels, each panel having opposite inboard and outboard major surfaces that are made of a thermoplastic material; a plurality of first thermoplastic welded junctions, each first thermoplastic welded junction providing an hermetically-sealed connection between adjacently-disposed lateral side edges of a corresponding pair formed by two juxtaposed ones of the panels; a plurality of elongated snap-in panel anchoring units, at least one for each panel, each snap-in anchoring unit including complementary first and second members to be latched together through an interfering engagement, at least the first member of each snap-in anchoring unit being made of a thermoplastic material; and a plurality of second thermoplastic welded junctions, each second thermoplastic welded junction being provided between a corresponding one of the first members of the snap-in panel anchoring units and the outboard major surface of a corresponding one of the panels.

Further details on the various aspects of the proposed concept will be apparent from the following detailed description and the appended figures.

DETAILED DESCRIPTION

Figure 1:
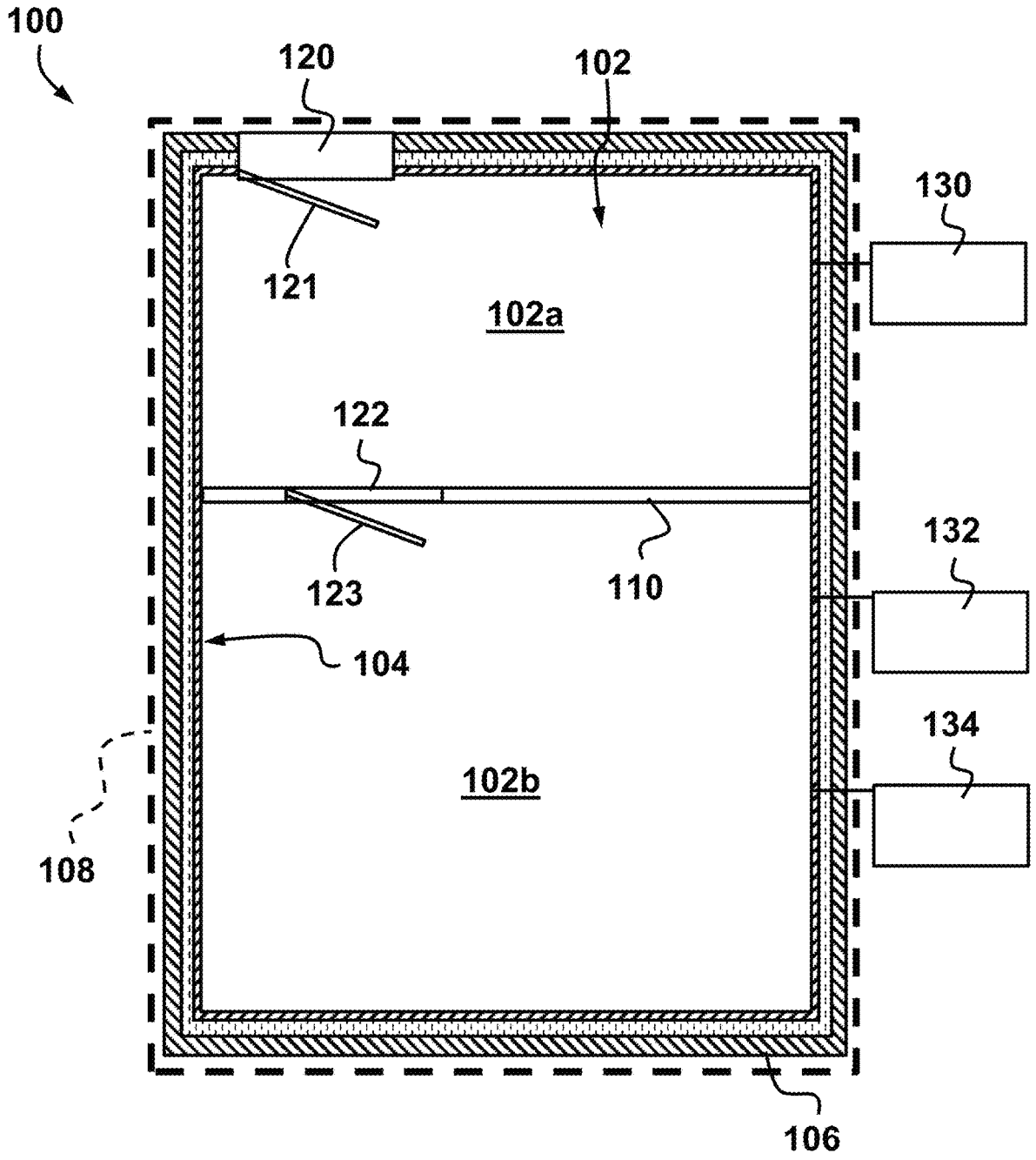
FIG. 1 is a semi-schematic top plan view of a generic example of a cleanroom in which the proposed concept can be implemented.

FIG. 1 is a semi-schematic top plan view of a generic example of a cleanroom 100 in which the proposed concept can be implemented. This cleanroom 100 creates and delimits a closed sealable space 102 therein. The proposed concept involves having a cleanroom panel system 104 to form the rigid shell or at least a part of the rigid shell around the space 102. The cleanroom panel system 104 includes a plurality of modular panels that are connected to an external supporting structure 106. These panels are also interconnected together along their mating edges in an airtight manner. The supporting structure 106 is said to be external since in general, the panels will form the interior of the cleanroom 100. This does not necessarily exclude having one or more supporting elements inside the cleanroom 100 in some implementations, for instance if the cleanroom 100 is very large in size since it may then have elements such as supporting columns or walls. One could even construct a cleanroom with multiple floors or levels.

The external supporting structure 106 can be, for instance, existing structural elements of a room or compartment 108 and/or a framework or armature, for instance one added inside the room or compartment 108. The framework or armature can include parts made of wood, metal, concrete and/or other materials that are attached to the existing structural elements. Examples of such structural elements include walls, ceilings, floors, columns, etc. In some implementations, the external supporting structure 106 can be self-supporting and/or be located outdoors instead of being provided inside a room or compartment 108. Other variants are possible as well.

The cleanroom panel system 104 can be used to build cleanrooms almost anywhere. This includes locations that are not necessarily buildings. For instance, a cleanroom can be constructed inside the box of a truck or a trailer, thereby allowing the cleanroom to be transported by road. Other similar locations include railroad cars, airplanes, ships and many others. Yet, a cleanroom can be constructed, using the cleanroom panel system 104, inside a decommissioned maritime container. Such container includes a rigid metallic outer structure and a relatively large space therein. This metallic outer structure could then correspond to item 108 shown in FIG. 1. A framework, including for instance wood studs or the like, can be added inside the container to form or to complete the external supporting structure 106, if required. Such container can be easily transported from one site to another. For instance, they can be installed on a short-term basis at a site due to an event or because of an outbreak, or be installed on a long-term basis next to another building.

The cleanroom 100 shown in FIG. 1 is only an example. The size, the shape and the configuration of the cleanroom 100 can vary from one implementation to another. Some of the features illustrated in FIG. 1 are also optional. For instance, although the space 102 inside the illustrated cleanroom 100 is subdivided in two subareas 102*a*, 102*b* by an inside wall 110, one can design a cleanroom 100 in which the space 102 is undivided, or a cleanroom 100 in which there are more than two subareas. Other variants are possible as well.

In FIG. 1, the interior of the cleanroom 100 is accessed through a main doorway 120 that is closed by a door 121 or by another similar element. Once in the first subarea 102*a*, a person must go through an internal doorway 122 to reach the second subarea 102*b*. The internal doorway 122 is closed by a door 123 or by another similar element. The first subarea 102*a* can be used for storage, cleaning and/or as a cloakroom, to name just a few examples. The second subarea 102*b* can then be the zone where the cleanness must be maximum or where the source of contamination to be contained is located. Many other variants are possible as well.

In most implementations, various support equipment are used with the cleanroom 100. They can be mounted inside and/or outside the space 102. The exact list of equipment will depend on the specific implementation. Equipment can include, in the example shown in FIG. 1, an electrical-power supply arrangement 130, an air conditioning/filtering arrangement 132 and a water-supply arrangement 134, to name just a few. These various arrangements are schematically depicted in FIG. 1. Many others are possible as well. This includes wastewater-disposal arrangements, gas-supply arrangements, etc. Some equipment can even be located far from the space 102 inside the cleanroom 100. They are thus not necessarily inside the space 102 or directly mounted on the cleanroom 100.

Figure 2:
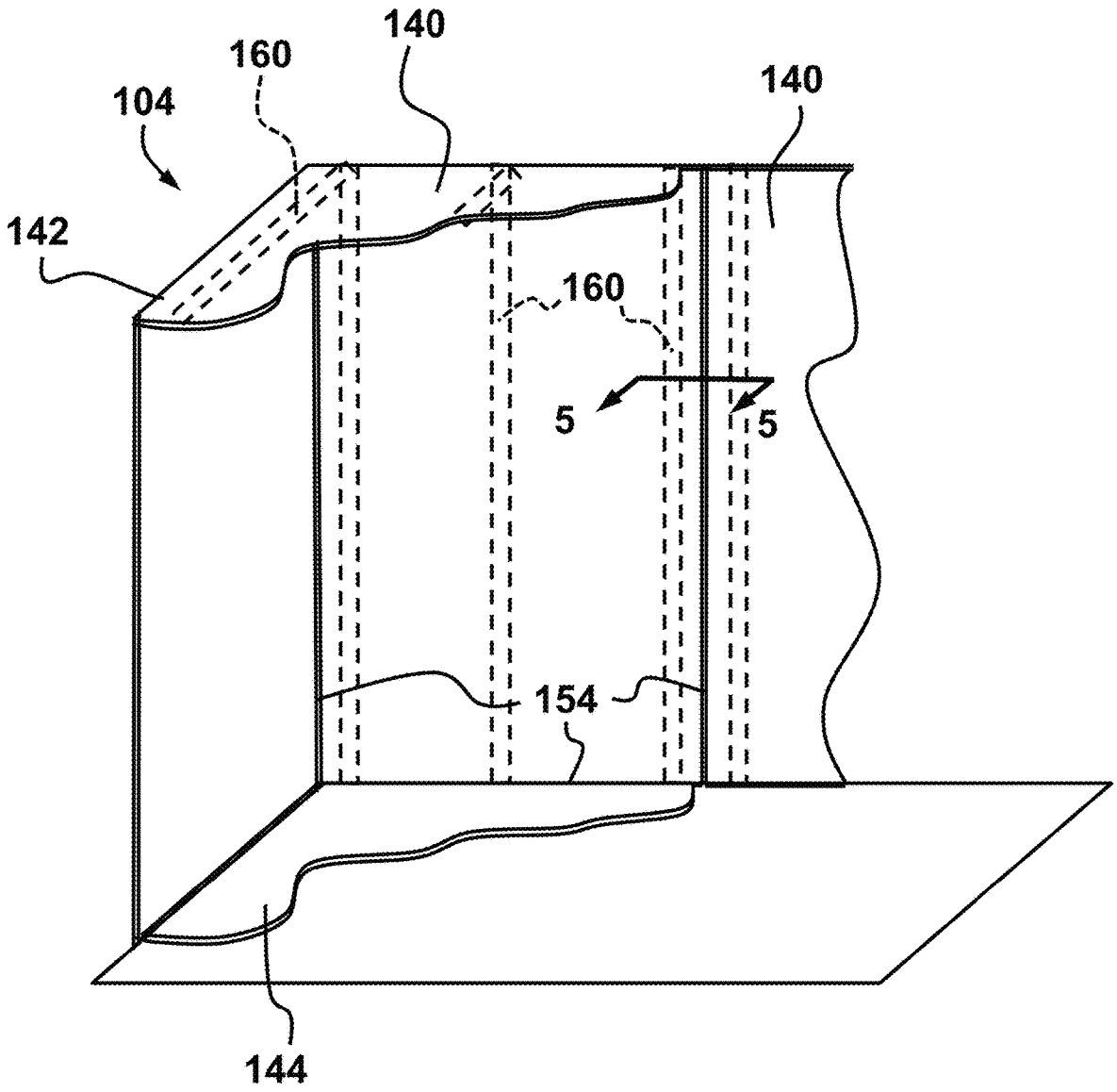
FIG. 2 is a semi-schematic isometric cutaway view illustrating an example of a cleanroom panel system, for instance to construct the cleanroom shown in FIG. 1.

FIG. 2 is a semi-schematic isometric cutaway view illustrating an example of a cleanroom panel system 104, for instance to construct the cleanroom 100 of the example shown in FIG. 1. The same system can also be used to construct a completely different one. This illustrated example shows different kinds of panels. Panels 140 are provided as wall panels. Panel 142 is a ceiling panel and panel 144 is a floor panel. Only a small number of panels are depicted in FIG. 2 for the sake of simplicity. The wall panels 140 and ceiling panels 142 will generally be directly mounted to the external supporting structure 106 and in some implementations, the floor panels 144 will be mounted over a supporting framework or armature instead of being laid directly on the ground floor. All panels 140, 142, 144 provided to make the cleanroom 100 are preferably shaped and dimensioned to create a complete airtight shell, with the exception of access points, such as a door, a window, a vent, a drain, etc.

It should be noted that the cleanroom panel system 104 minimally includes wall panels 140 since in some implementations, the ceiling panels 142 and/or the floor panels 144 can be unnecessary. This may be because there is an existing ceiling and/or floor suitable for use inside the cleanroom 100. The proposed concept also applies to these implementations. However, for the sake of simplicity, the present detailed description mainly refers to an implementation where wall panels 140 are used together with ceiling panels 142 and floor panels 144. Each panel 140, 142, 144 has opposite inboard and outboard major surfaces. FIG. 2 shows the inboard side of the wall panels 140 and of the floor panel 144. It also shows the outboard side of the ceiling panel 142.

Figure 3:
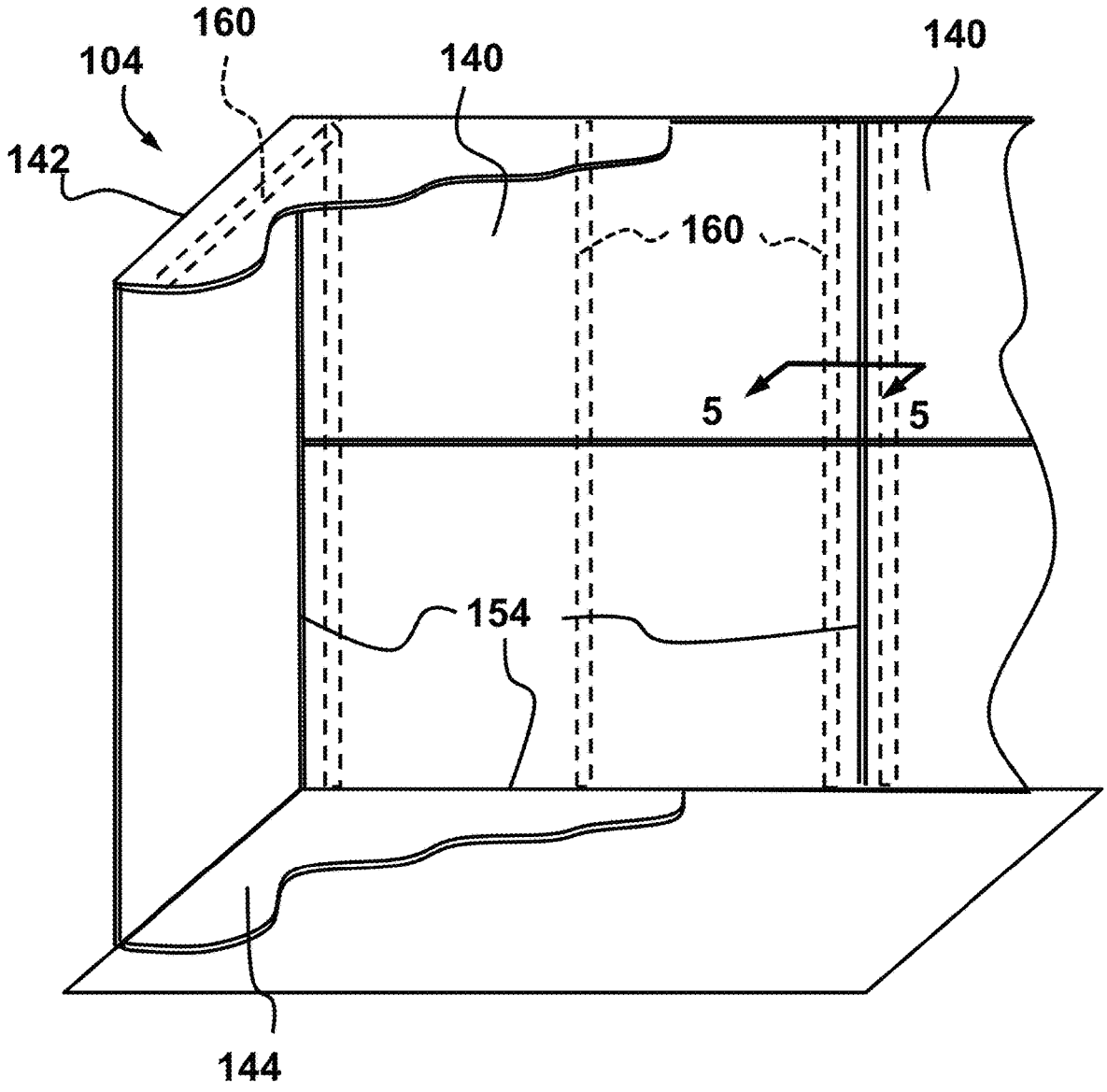
FIG. 3 is a view similar to FIG. 2 and illustrates an example of another panel arrangement for the cleanroom panel system.

The panels 140, 142, 144 of the example illustrated in FIG. 2 have a rectangular shape and planar surfaces. The wall panels 140 are also vertically-standing panels, having their longest sides extending substantially parallel to a vertical axis. One can set the wall panels 140 differently, for instance in manner where the longest sides extend substantially parallel to a horizontal axis, as shown in FIG. 3. FIG. 3 is a view similar to FIG. 2 and illustrates an example of another panel arrangement for the cleanroom panel system 104. Other variants are possible as well. For instance, the panels 140, 142, 144 may have different shapes and thus not be rectangular, and/or be nonplanar. Some panels may also be curved. Other variants are possible as well.

If desired, one or more windows can be added. Window openings can be made through the wall panels 140. They can also be made through the ceiling panels 142 and/or the floor panels 144 in some implementations.

Depending on the requirements, the panels 140, 142, 144 can be single-layered panels or multi-layered panels. A same cleanroom 100 can include both single-layered panels and multi-layered panels. An example of a single-layered panel is a flat monolithic sheet panel made of a same material. Multi-layered panels are sometimes referred to as composite or sandwich panels. A multi-layered panel is generally having at least two juxtaposed flat sheet panels with or without an intervening space between them. The intervening space can simply be an air space or be filled, at least in part, with a layer of another material, such as a thermal and/or acoustic insulation material. This material can be in the form of a rigid panel, be a hardened material injected inside the intervening space, or be a filling bulk material added inside the intervening space. Many other variants are possible as well.

Figure 4:
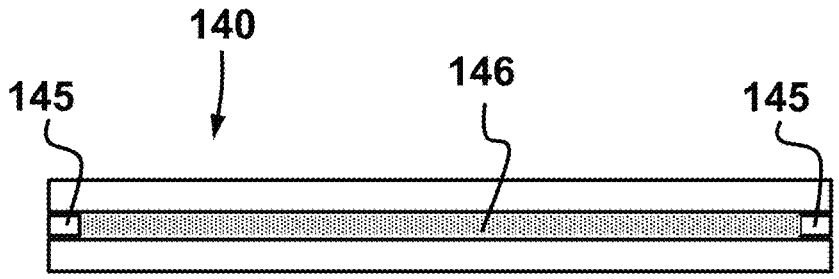
FIG. 4 is a semi-schematic cross-sectional view of an example of a multilayered panel.

FIG. 4 is a semi-schematic cross-sectional view of an example of a multilayered panel, for instance a wall panel 140. This wall panel 140 has spacers 145 to keep the two flat sheet panels separated. There is also an insulation material layer 146 between them. Variants are possible as well.

In the proposed concept, at least the inboard major surfaces and the outboard major surfaces of the panels 140, 142, 144 of the cleanroom panel system 104 are made of a thermoplastic material. A thermoplastic material can be broadly defined as a polymeric material having the property of softening or fusing when heated and of hardening and becoming rigid again when cooled. It is thus not a thermoset material since the latter is relatively incapable of softening or fusing when heated. Examples of thermoplastics include high-density polyethylene (HDPE), Polyvinyl chloride (PVC), and many others.

The composition of the thermoplastic material can include only a single kind of thermoplastic, a blend of two or more kinds of thermoplastics, or a blend of one or more kinds of thermoplastics with one or more materials that are not thermoplastics or even polymers. The resulting composition, however, must still exhibit the main characteristics of a thermoplastic material wherever thermoplastic welding junctions will be provided. Generally, a thermoplastic material includes at least 50% vol. of thermoplastics but variants are possible.

It should be noted that while panels in the cleanroom panel system 104 are said to be made of thermoplastic material, they may still include added elements that are not made of a thermoplastic material. For instance, in the multi-layered wall panel 140 shown in FIG. 4, the insulation material layer 146 can be made of a material that is not a thermoplastic material. Other variants are possible as well.

The various panels in the cleanroom panel system 104 are assembled together by thermoplastic welding, namely a process by which the two parts are rigidly attached by melting and then cooling some of the thermoplastic materials on the panels themselves to create thermoplastic welded junctions. Only adding a molten material between adjacent parts and cooling this added material until it solidifies is merely adhesion and it does not create a thermoplastic welded junction because the adjacent parts are not also molten and fused with the added material. A thermoplastic welded junction is created when heat is applied directly at the site using a corresponding tool and the heat locally melts the thermoplastic welding rod as well as a thin layer of the material on the two parts. The thermoplastic welding rod is usually fed by the welding tool. It is generally made of the same material as the surrounding parts.

Also, for the record, the expression "thermoplastic welded junction" refers to a physical element (i.e. seam) that will be present on the final installed product itself, even long after the welding work is completed. This physical element will be visually recognizable by someone skilled in the art.

Welding the panels 140, 142 and/or 144 of the cleanroom panel system 104 creates a plurality of thermoplastic welded junctions 154. Each thermoplastic welded junction 154 creates a strong and hermetically-sealed connection between adjacently-disposed lateral side edges of a corresponding pair formed by two juxtaposed ones of the panels 140, 142, 144.

Figure 5:
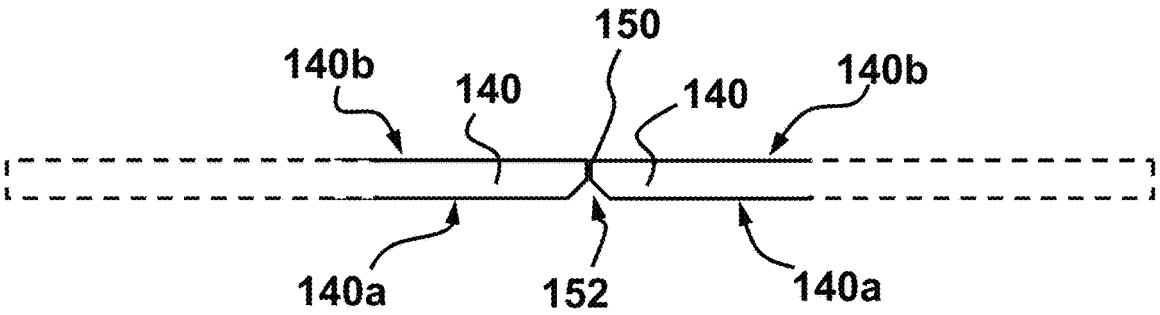
FIG. 5 is a semi-schematic enlarged horizontal cross-sectional view taken along line 5-5 in FIGS. 2 and 3 but prior to the thermoplastic welding.

FIG. 5 is a semi-schematic enlarged horizontal cross-sectional view taken along line 5-5 in FIGS. 2 and 3 but prior to the thermoplastic welding. FIG. 5 illustrates two adjacently-disposed wall panels 140 that are abutting on their mating faces 150. In this implementation, a groove 152 was made, prior to the welding, along the entire length of the junction using a machining tool. The main goal of the groove 152 is to maximize the contact surface between the welding seam and the surrounding parts with which seam is fused. The groove 152 can be V-shaped as shown and generally goes at least half of the thickness of the panel 140. Variants are possible as well. For instance, other thermoplastic welding techniques may use an X-shaped groove that is formed by two opposite V-shaped grooves, one on each side of the panel 140. However, the outboard side of the panels 140 will often be inaccessible for welding and the X-shaped groove may thus not always be possible. The groove 152 can be made before the panels 140 are in position, for instance with each half of the groove 152 being machined independently, or be machined once the panels 140 are in position and even attached to the external supporting structure 106. Other variants are possible as well. The relative angle between the surfaces inside the V-shaped groove 152 is often about 50 to 60 degrees. Other values are possible.

Figure 6:
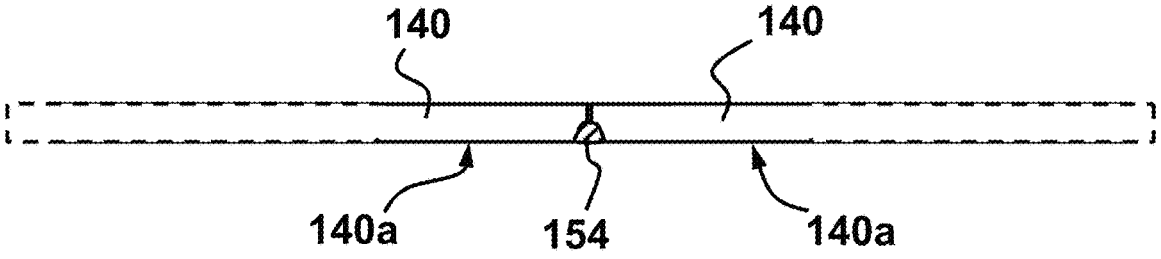
FIG. 6 is a view similar to FIG. 5 and illustrates the same parts after the thermoplastic welding.

FIG. 6 is a view similar to FIG. 5 and illustrates the same parts after the thermoplastic welding. It shows the two adjacent panels 140 being now rigidly connected through a corresponding thermoplastic welded junction 154. The seam forming the thermoplastic welded junction 154 extends continuously along the entire length of the two wall panels 140. Variants are possible as well.

Unlike prior arrangements where the junctions are sealed using elements such as gaskets and/or sealant beads, the seams of the thermoplastic welded junctions 154 are very durable. They will not dry or otherwise fail. They can also be made virtually invisible, for instance using a grinder or sand paper, if this is required. As can be seen in the example of FIG. 6, this thermoplastic welded junction 154 is almost entirely contained within the thickness of the panels 140. The inboard surfaces 140*a* of the wall panels 140 are flat so as to create a substantially flush and seamless transition between the wall panels 140. It is often desirable that discontinuities on inboard surfaces be minimized, in particular for preventing contaminants from accumulating along these discontinuities and to facilitate cleaning.

The cleanroom 100 constructed using the cleanroom panel system 104 can be used in a wide variety of applications. Some of them includes holding living animals for a given time period. Some animals are known to react differently from others to details in their surrounding environment and this must often be taken into account in the design of the panels that will be around these animals. For example, when the cleanroom 100 is intended for pigs, using horizontally-disposed wall panels 140, such as shown in FIG. 3, is generally desirable since the length of seams directly at the level of their heads is minimized. Pigs tend to damage anything that protrudes out from a smooth surface they can reach and accordingly, making the thermoplastic welded junctions 154 nearly invisible near the floor should also be considered. With other animals, for instance horses, this is not relevant. However, for large animals such as horses, it is generally desirable that the overall construction be very strong on at least the lower parts of the wall panels 140 in order to withstand the forces they can apply. Moreover, horses and other animals may not react well if they sense that the panels surrounding them are somewhat loose or if they otherwise appear not solid enough for them. Among other things, the number of snap-in anchoring units 160 should be increased in these cases. Other situations exist as well.

Welding thermoplastic panels together in order to seal all junctions in an airtight manner is not necessarily an easy task to accomplish. The thermoplastic welding is done on a commercial basis by specialized thermoplastic welders using an appropriate equipment, such as a welding gun having a nozzle expelling a plume of hot air in a controlled manner. Other thermoplastic welding techniques may be used as well, including sonic welding and others.

Regardless of the welding technique carried out by the specialized thermoplastic welder, the adjacent panels 140, 142 and/or 144 must be properly positioned before the welding begins and they must remain stationary during welding. However, holding the panels using conventional clamps or the like is often difficult and inefficient. The ceiling panels 142 can be particularly challenging to hold in position.

Moreover, it is also often highly undesirable to affix the panels 140, 142, 144 to the external supporting structure 106 using fasteners, such as nails or screws, extending across the thickness of the panels 140, 142, 144 from the inside, namely from the inboard side towards the outboard side. The screw heads and the resulting holes to accommodate them will create highly-undesirable discontinuities on the inboard side surfaces. Using fasteners going into the panels from the outside is often even more difficult because the fasteners must not protrude out on the inboard side. The fasteners must thus extend only partially into the panels. However, when the panel is a relatively-thin sheet of thermoplastic, the holding force of each fastener will be greatly reduced because of the depth limitations. The resistance to vibrations will also be very low in such situation and this could be a concern, for instance if the cleanroom is intended to be transported once assembled.

Figure 7:
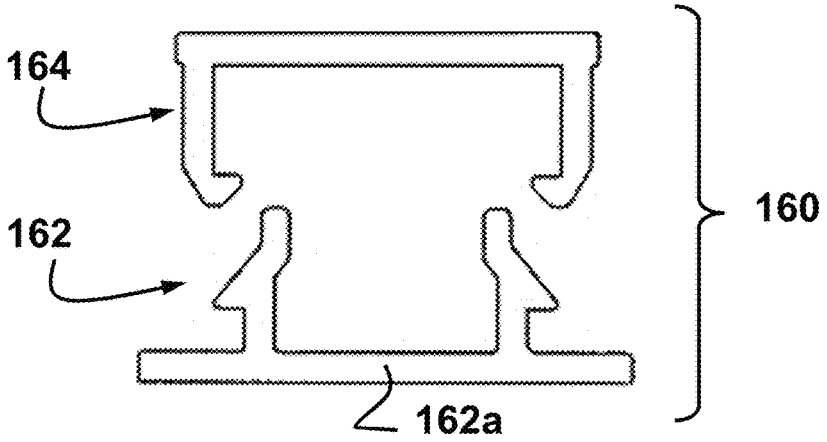
FIG. 7 is an end view illustrating the two unlatched members of an example of a snap-in panel anchoring unit.

FIG. 7 is an end view illustrating the two unlatched members of an example of an elongated snap-in panel anchoring unit 160. In the cleanroom panel system 104, there is a plurality of snap-in panel anchoring units 160 and at least one for each panel 140, 142, 144. Some snap-in panel anchoring units 160 are schematically depicted in FIGS. 2 and 3. They are provided for supporting the walls panels 140 and the ceiling panels 142. They exact number of units 160 and their position may vary from one implementation to another. These snap-in panel anchoring units 160 are also suitable for the floor panels 144 of some implementations.

Each snap-in panel anchoring unit 160 includes complementary first and second members 162, 164 to be press-fitted and this will make them latch together through an interfering engagement, for instance including opposite oblique surfaces forcing the side flanges of the second member 164 to bend outwards until corresponding flat surfaces are facing one another. The flanges of the first member 162 will then be trapped inside the second member 164, as shown in the example illustrated in FIG. 7. The length of the various flanges is also substantially identical in the example so as to minimize the relative outward movement between the members 162, 164 once they are latched. The snap-in panel anchoring units 160 can be set to extend vertically, as shown, and/or horizontally if desired. Using obliquely-disposed units 160 is also possible as well. Other variants are possible as well.

At least the first member 162 of each snap-in panel anchoring unit 160 is made of a thermoplastic material. The second member 164 can be made of a thermoplastic material or be made of a material that is not a thermoplastic material. Thus, for instance, the second member 164 can be made of a metallic material. The first member 162, since it is made of a thermoplastic material, can be welded directly onto the outboard side of the panels 140, 142, 144. This will create a plurality of second thermoplastic welded junctions 170. Each second thermoplastic welded junction 170 is located between a corresponding one of the first members 162 of the snap-in panel anchoring units 160 and the outboard major surface of a corresponding one of the panels 140, 142, 144.

Figure 8:
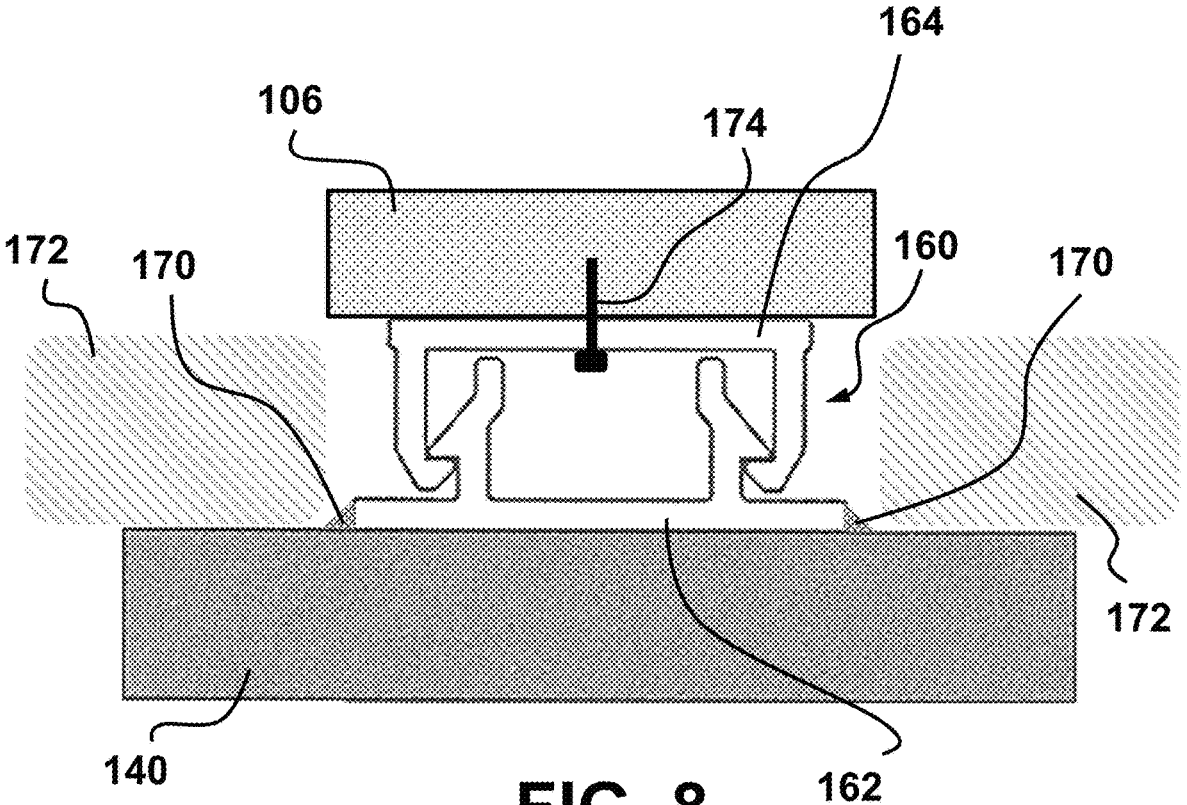
FIG. 8 is an end view illustrating the two members of the snap-in panel anchoring unit shown in FIG. 7 once in position and latched together.

FIG. 8 is an end view illustrating the two members 162, 164 of the snap-in panel anchoring unit 160 shown in FIG. 7 once in position and latched together. As can be seen, the two members 162, 164 are C-shaped in the illustrated example. Other shapes are possible as well. The two members 162, 164 are designed so that there will be no or almost no relative movement between them once they are latched. They are also designed so that the latching is unidirectional, namely that they will be very difficult to remove once latched. It is even possible to design them so that they are impossible to remove without breaking them. Variants are possible as well.

In FIG. 8, the seams of the second thermoplastic welded junctions 170 are at the opposite ends of the extended base 162*a* of the first member 162. The base 162*a* is made wider than the corresponding latching parts. This feature can give more space to the welder to facilitate the welding operation. Variants are possible as well.

Also in the example shown in FIG. 8, layers of insulation material 172 are provided between the back of the wall panel 140 and the external supporting structure 106. These insulation material layers 172 are optional and can be omitted in some implementations.

Furthermore, in FIG. 8, the second member 164 is attached to the external supporting structure 106 using a plurality of spaced-apart fasteners 174. Other fastening methods are possible as well.

Figure 9:
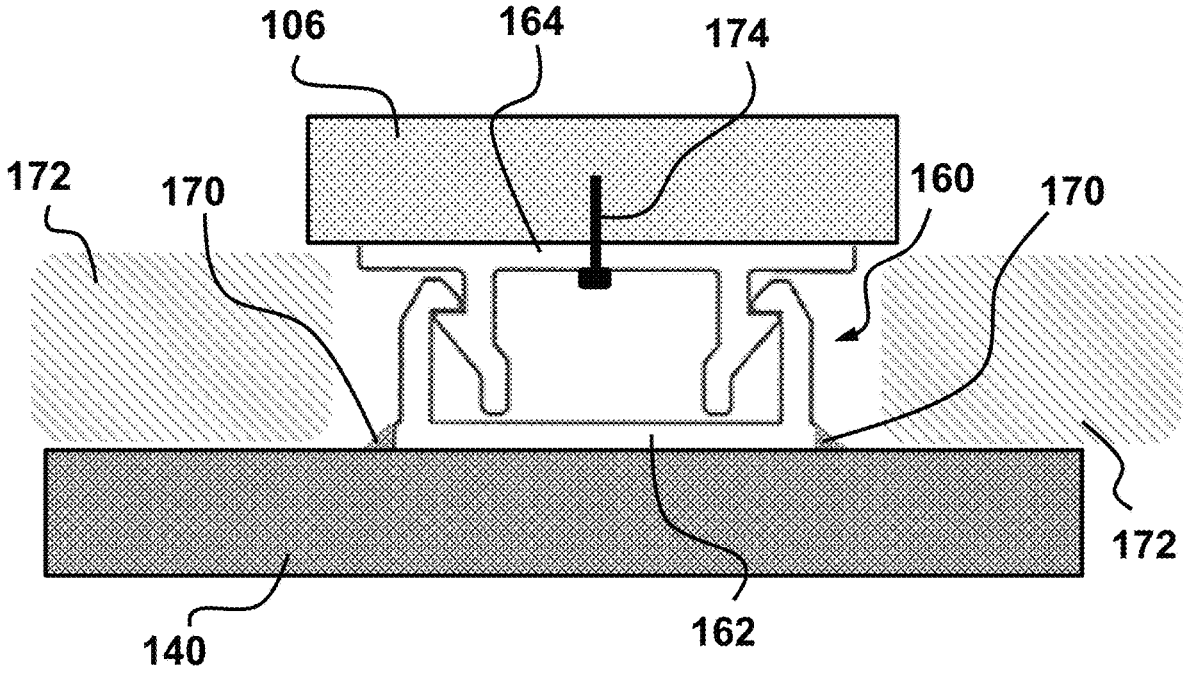
FIG. 9 is a view similar to FIG. 8 and illustrates an example where the relative position of members of the snap-in panel anchoring unit shown in FIG. 7 is inverted.

FIG. 9 is a view similar to FIG. 8 and illustrates an example where the relative position of members 162, 164 of the snap-in panel anchoring unit 160 shown in FIG. 7 is inverted. Thus, the member that was the first member 162 in FIG. 8 is now the second member 164 in FIG. 9, and vice-versa.

Figure 10:
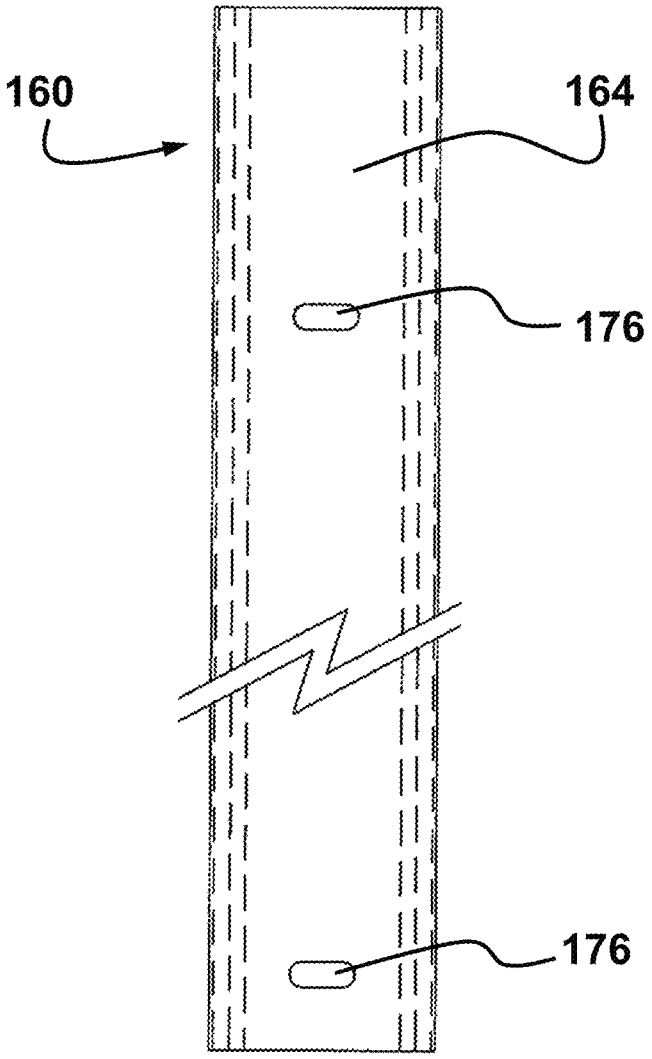
FIG. 10 is a semi-schematic side view illustrating the outboard side of the second member of the snap-in panel anchoring unit shown in FIG. 7.

FIG. 10 is a semi-schematic side view illustrating the outboard side of the second member 164 of the snap-in panel anchoring unit 160 shown in FIG. 7. It shows that the second member 164 of the illustrated example has a plurality of spaced-apart holes 176 along its length. These holes 176 will receive the fasteners 174. They are preferably performed in the second member 164 but they could also be former differently if needed. The holes 176 create visual indicators to help with the positioning of the fasteners 174. The holes 176 are also facilitating the positioning of the second member 164 over a corresponding parts of the external supporting structure 106 since the installer will be able to see if the second member 164 is aligned correctly. Nevertheless, one can omit these holes 176 in some implementations or use a different arrangement.

Figure 11:
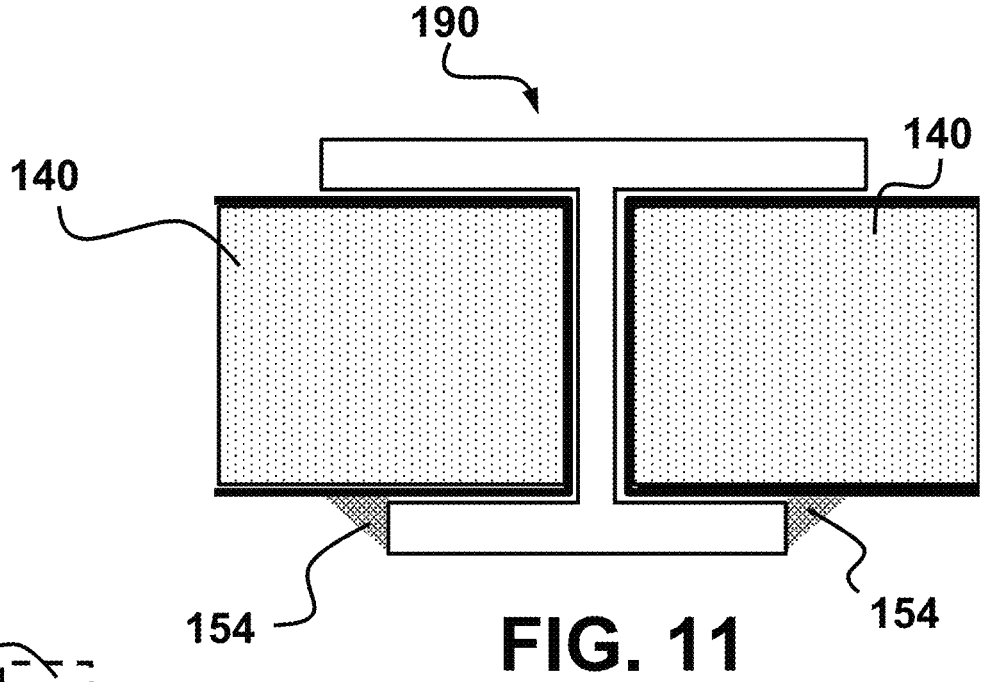
FIG. 11 is a semi-schematic enlarged horizontal cross-sectional view illustrating an example of an H-shaped bridging connector for use between two adjacent panels that are coplanar.

FIG. 11 is an enlarged horizontal cross-sectional view illustrating an example of an H-shaped bridging connector 190 for use between two adjacent panels that are coplanar. This bridging connector 190 is made of the same thermoplastic materials as the panels. It can be useful for instance if the edge of one panel, or of both panels, are not perfect. The bridging connector 190 will then fill the voids. The thermoplastic welded junctions 154, particularly when they have a substantially oblique outer surface, will be easy to clean.

It should be noted that FIG. 11 shows an example where the bridging connector 190 has a shorter part on the inboard side than on the outboard side. One can design the bridging connector 190 differently as well.

Figure 12:
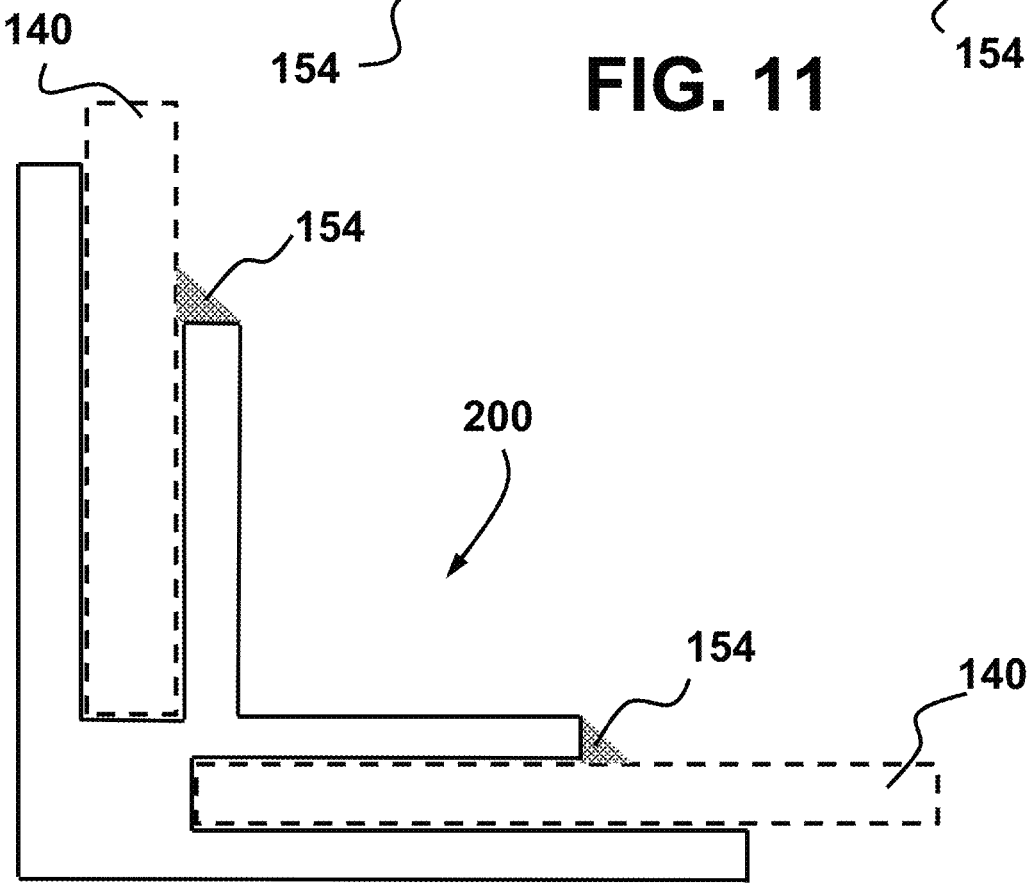
FIG. 12 is a semi-schematic enlarged horizontal cross-sectional view illustrating an example of a bridging connector for use between two adjacent panels that are not coplanar.

FIG. 12 is an enlarged horizontal cross-sectional view illustrating an example of a bridging connector 200 between two adjacent panels that are not coplanar. The example depicts wall panels 140 that are 90 degrees apart, such as found in a corner. The bridging connector 200 can also be used between wall panels 140 and ceiling panels 142 (see FIG. 3) and/or between wall panels 140 and floor panels 144 (see FIG. 3). The panels can also be positioned at angles other than 90 degrees using corresponding bridging connectors.

Figure 13:
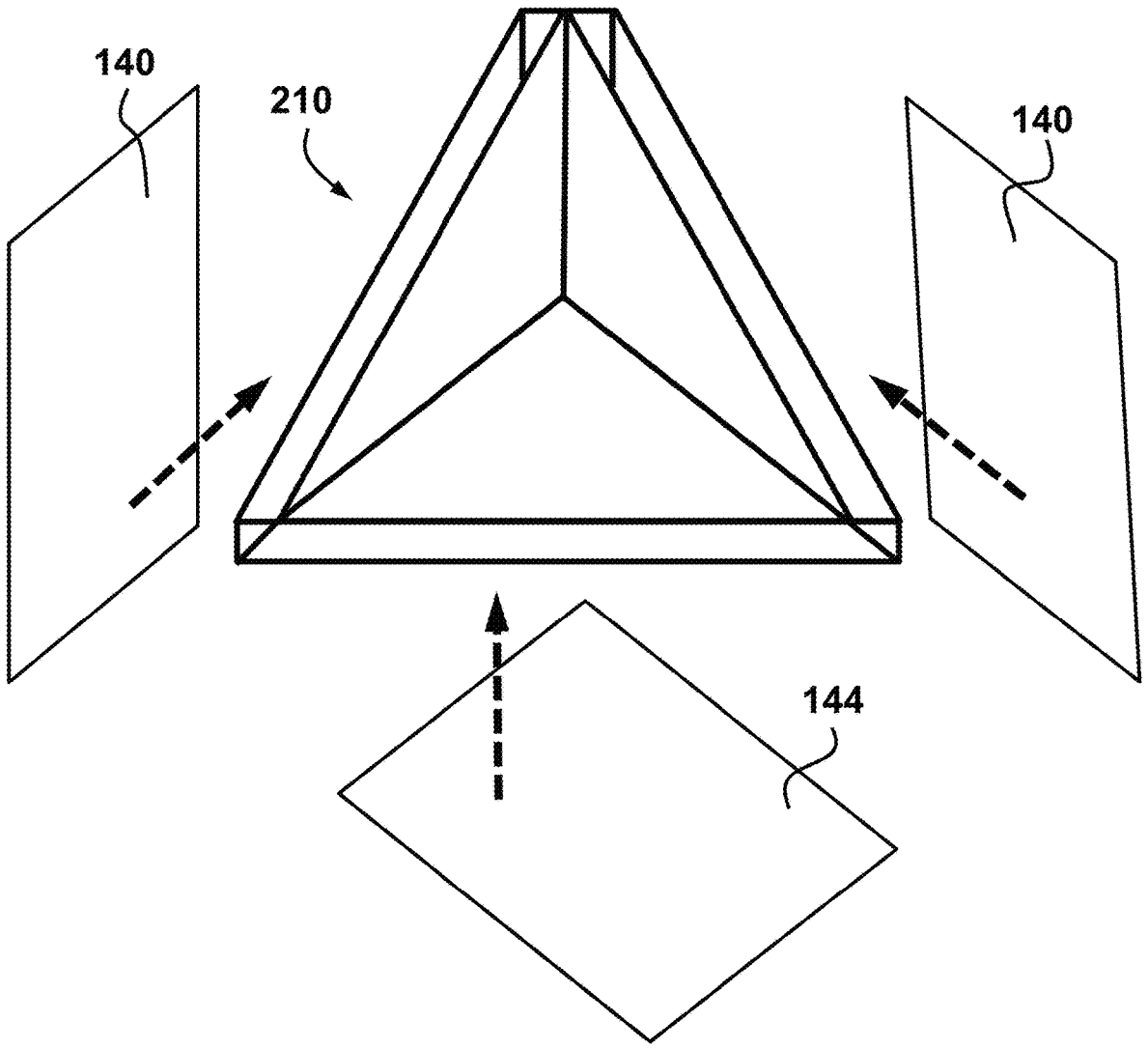
FIG. 13 is a semi-schematic enlarged isometric view illustrating an example of a bridging connector for use in a corner formed by three juxtaposed panels.

FIG. 13 is a semi-schematic enlarged isometric view illustrating an example of a bridging connector 210 for use in a corner formed by three juxtaposed panels 140, 144. These panels 140, 144 are schematically shown in FIG. 13. Thermoplastic welded junctions 154 will then be added to attach them together. Such bridging connector 210 can also be used for the connection between three panels 140 and 142 (see FIG. 3).

Figure 14:
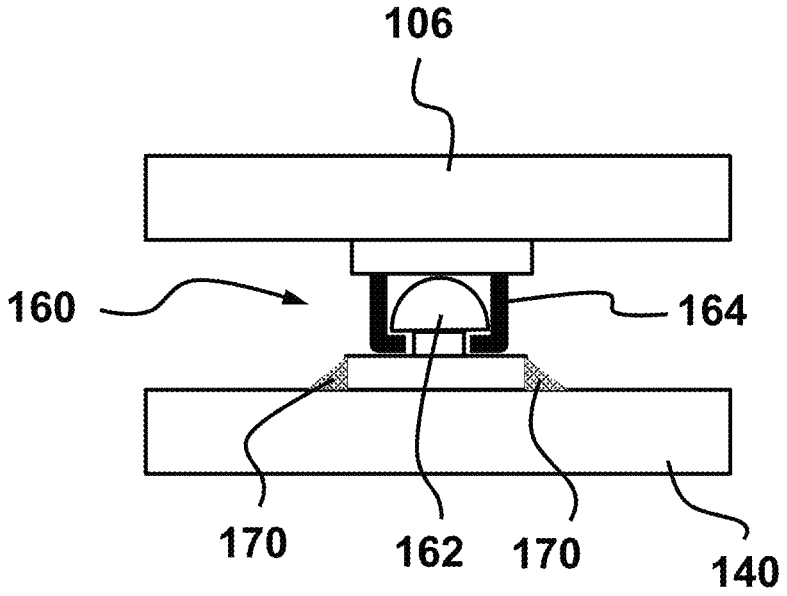
FIG. 14 is an end view illustrating the two latched members of another example of a snap-in panel anchoring unit.

FIG. 14 is an end view illustrating the two latched members 162, 164 of another example of a snap-in panel anchoring unit 160.

Figure 15:
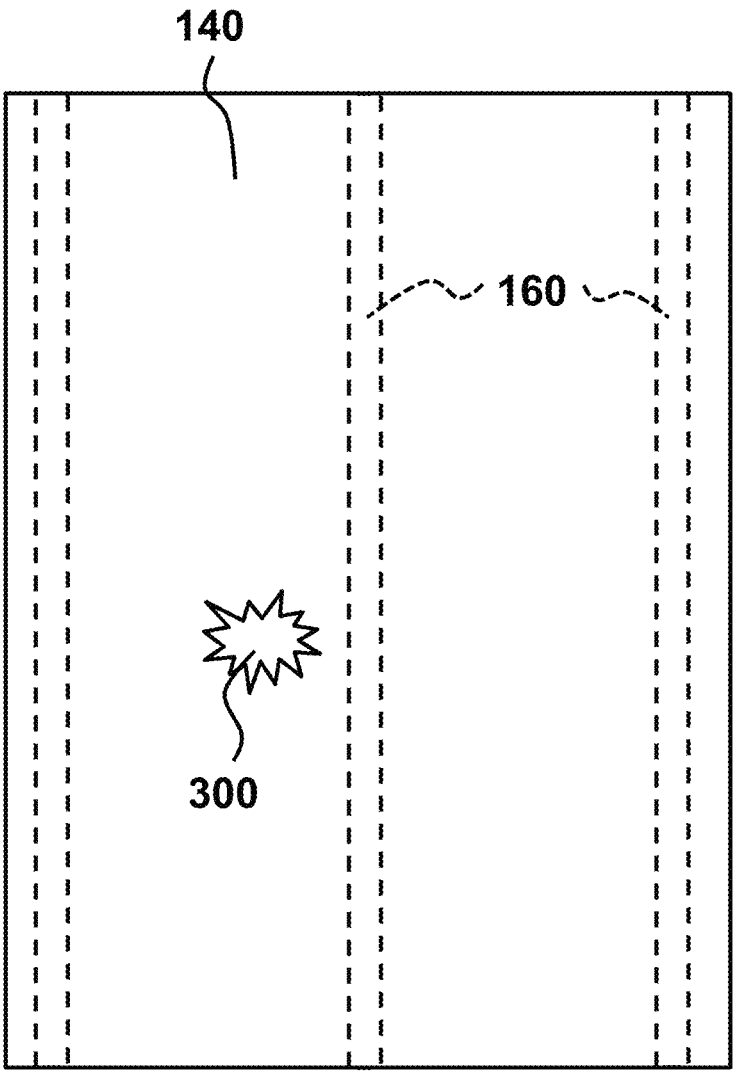
FIG. 15 is a semi-schematic view illustrating an example of a damaged area on a wall panel.

FIG. 15 is a semi-schematic view illustrating an example of a damaged area 300 on a panel, in this case a wall panel 140. The damaged area 300 can be the result, for instance, of a large animal hitting the wall panel 140 with force. This impact created a hole that must be repaired.

Figure 16:
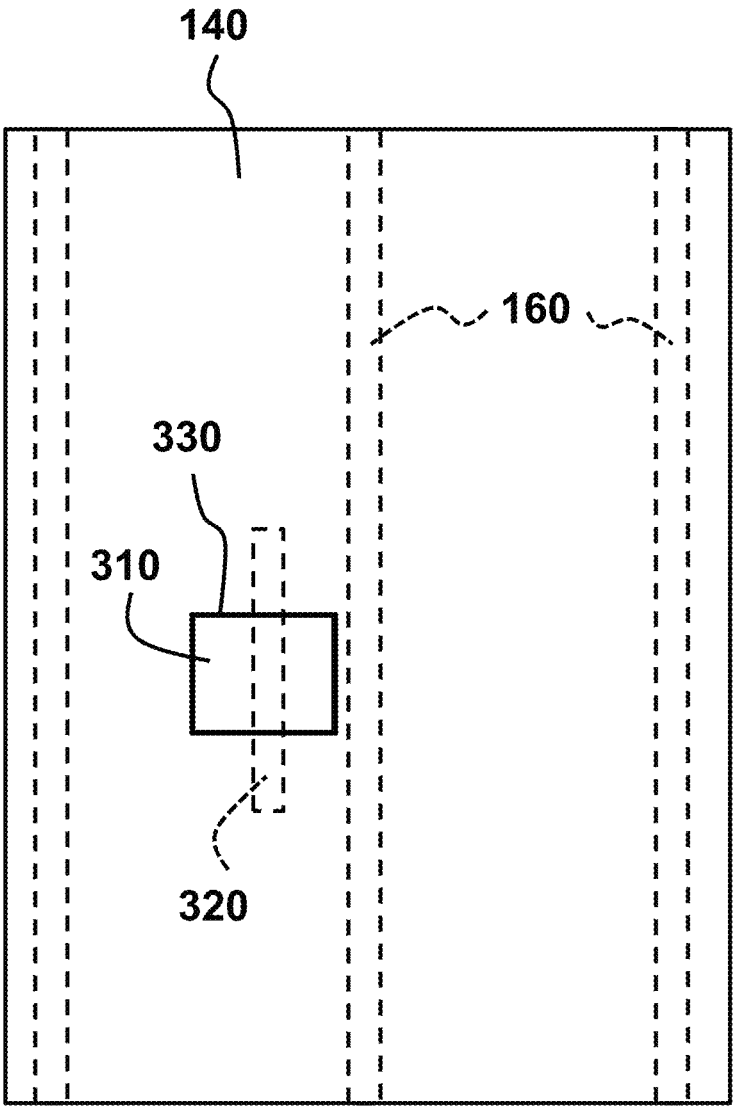
FIG. 16 is a view similar to FIG. 15 and illustrates an example on a repair that was made to fix the damaged area shown in FIG. 15.

FIG. 16 is a view similar to FIG. 15 and illustrates an example on a repair that was made to fix the damaged area 300 shown in FIG. 15. This could have been done to a ceiling panel or even to a floor panel, depending on the implementation.

The repair was made by cutting a larger clean opening around the damaged area 300. A square-shaped opening was made but other shapes are possible as well, including for instance a round shape. A patch 310, made of an identical or very similar thermoplastic material, was cut to fit perfectly inside the perimeter of the opening cut around the damaged area. This patch 310 should match with the rest of the wall panel 140 to make the repair as unnoticeable as possible.

Prior to the insertion of the patch 310, a snap-in anchoring unit segment 320 was cut from a longer snap-in panel anchoring unit 160. The first member of this snap-in anchoring unit segment 320 was then attached at the back of the patch 310 by thermoplastic welding. The length of the first member matches the height of the patch 310 or is made smaller but the second member is longer in the illustrated example. This second member is depicted by the stippled lines. It was inserted through the opening beforehand and attached to the external supporting structure 106. The second member extends across the opening so as to receive the first member that will be attached on the back of the patch 310. The first and second members will be in a latching engagement upon insertion of the patch 310 in the opening. Then, the periphery of the patch 310 was grooved and the thermoplastic welding was made. This created a thermoplastic welded junction 330 securing the patch 310 to the wall panel 140.

The present detailed description and the appended figures are meant to be exemplary only, and a skilled person will recognize that many changes can be made while still remaining within the proposed concept. The invention is thus not limited to the described examples and encompasses any alternative embodiments within the limits defined by the claims. For instance, the exact shape of the various components can differ from what is shown and described, depending on the needs. Still, many other variants of the proposed concept will be apparent to a skilled person, in light of a review of the present disclosure.

LIST OF REFERENCE NUMERALS

100 cleanroom
102 closed sealable space
**102*a*** subarea
**102*b*** subarea
104 cleanroom panel system
106 external supporting structure
108 room or compartment
110 inside wall
120 main doorway
121 door
122 internal doorway
123 door
130 electrical-power supply arrangement
132 air conditioning/filtering arrangement
134 water-supply arrangement
140 wall panel
**140*a*** inboard side (of a wall panel)
**140*b*** outboard side (of a wall panel)
142 ceiling panel
144 floor panel

145 spacer
146 insulation material layer
150 mating faces
152 groove
154 thermoplastic welded junction (first)
160 snap-in panel anchoring unit
162 first member
162*a* base
164 second member
170 thermoplastic welded junction (second)
172 insulation material layer
174 fastener
176 hole
190 bridging connector
200 bridging connector
210 bridging connector
300 damaged area
310 patch
320 snap-in anchoring unit segment
330 thermoplastic welded junction

What is claimed is:

1. A cleanroom panel system including:

a plurality of panels, each of the panels having opposite inboard and outboard major surfaces that are made of a thermoplastic material;

a plurality of first thermoplastic welded junctions, each of the first thermoplastic welded junctions providing a hermetically-sealed connection between adjacently-disposed lateral side edges of a corresponding pair formed by two juxtaposed ones of the panels;

a plurality of elongated snap-in panel anchoring units, at least one for each of the panels, each of the snap-in panel anchoring units including complementary first and second members to be latched together through an interfering engagement, at least the first member of each of the snap-in panel anchoring units being made of a thermoplastic material; and a plurality of second thermoplastic welded junctions, each of the second thermoplastic welded junctions being provided between a corresponding one of the first members of the snap-in panel anchoring units and the outboard major surface of a corresponding one of the panels.

2. The cleanroom panel system as defined in claim 1, wherein there is a plurality of snap-in panel support units for each of the panels.

3. The cleanroom panel system as defined in claim 1, wherein at least some of the second members of the snap-in panel anchoring units are made of a thermoplastic material.

4. The cleanroom panel system as defined in claim 1, further including an external supporting structure, at least some of the second members of the snap-in panel anchoring units being affixed to the external supporting structure using fasteners.

5. The cleanroom panel system as defined in claim 4, wherein the external supporting structure is provided inside a decommissioned maritime container.

6. The cleanroom panel system as defined in claim 1, wherein at least some of the first members of the snap-in panel anchoring units are C-shaped.

7. The cleanroom panel system as defined in claim 1, wherein the latching engagement between the first and second members of the snap-in panel anchoring units is unidirectional.

8. The cleanroom panel system as defined in claim 1, wherein at least some of the panels are single-layered.

9. The cleanroom panel system as defined in claim 1, wherein at least some of the panels are a multi-layered construction.

10. The cleanroom panel system as defined in claim 9, wherein at least some of the panels having the multi-layered construction each include two juxtaposed flat sheet panels with intervening spacers.

11. The cleanroom panel system as defined in claim 10, wherein at least some of the panels each include an internal layer of an acoustic insulation material between the two juxtaposed flat sheet panels.

12. The cleanroom panel system as defined in claim 1, wherein at least some of the first thermoplastic welded junctions are provided on a corresponding bridging connector that engages edges of at least another one of the panels and that is made of a thermoplastic material.

13. The cleanroom panel system as defined in claim 1, wherein the panels of the cleanroom panel system include only wall panels.

14. The cleanroom panel system as defined in claim 1, wherein the panels of the cleanroom panel system include only wall panels and ceiling panels.

15. The cleanroom panel system as defined in claim 1, wherein the panels of the cleanroom panel system include only wall panels and floor panels.

16. The cleanroom panel system as defined in claim 1, wherein the panels of the cleanroom panel system include wall panels, ceiling panels and floor panels.

17. The cleanroom panel system as defined in claim 1, further including bridging connectors that are made of a thermoplastic material, at least some of the bridging connectors being located between at least some of the adjacently-disposed lateral side edges of the panels.

18. The cleanroom panel system as defined in claim 17, wherein the thermoplastic material of the opposite inboard and outboard major surfaces of the panels, the thermoplastic material of the first members of the snap-in panel anchoring units and the thermoplastic material of the bridging connectors are identical.

19. The cleanroom panel system as defined in claim 18, wherein at least some of the first thermoplastic welded junctions are provided along at least some of the bridging connectors.

20. The cleanroom panel system as defined in claim 18, wherein at least one of the bridging connectors is provided at a corner where three of the panels are interconnecting.

* * * * *